US007423548B2

(12) United States Patent
Kontovich

(10) Patent No.: US 7,423,548 B2
(45) Date of Patent: Sep. 9, 2008

(54) MULTI-FUNCTION EGRESS PATH DEVICE

(76) Inventor: Michael Stephen Kontovich, 310 Dodds Ave., Chattanooga, TN (US) 37404

( * ) Notice: Subject to any disclaimer, the term of this patent is extended or adjusted under 35 U.S.C. 154(b) by 230 days.

(21) Appl. No.: 11/241,026

(22) Filed: Sep. 30, 2005

(65) Prior Publication Data

US 2006/0077069 A1 Apr. 13, 2006

Related U.S. Application Data

(60) Provisional application No. 60/614,434, filed on Sep. 30, 2004.

(51) Int. Cl.
*G08B 3/00* (2006.01)

(52) U.S. Cl. ..... 340/691.1; 340/825.36; 340/825.49; 340/326; 340/331; 340/332; 40/423; 40/431; 40/429; 40/430; 40/541; 40/570

(58) Field of Classification Search ..... 340/691.1, 340/825.36, 825.49, 286.02, 311.2, 326, 340/321, 330, 331, 332; 40/423, 431, 429, 40/430, 436, 456, 541, 570
See application file for complete search history.

(56) References Cited

U.S. PATENT DOCUMENTS 4,246,715 A * 1/1981 Nelson ..... 40/606.09
4,951,045 A * 8/1990 Knapp et al. ..... 340/944
5,140,301 A 8/1992 Watanabe
5,566,484 A * 10/1996 Wachter ..... 40/570
5,839,458 A * 11/1998 Delcarson ..... 134/113
6,150,943 A 11/2000 Lehman et al.
6,181,251 B1 1/2001 Kelly
6,457,270 B1 * 10/2002 Stark et al. ..... 40/570
6,471,388 B1 * 10/2002 Marsh ..... 362/559
6,606,808 B2 * 8/2003 Katz ..... 40/570
6,763,624 B2 * 7/2004 Gow ..... 40/560
7,012,544 B2 * 3/2006 Cunningham et al. .. 340/815.55
7,158,025 B2 * 1/2007 Matoba ..... 340/517
7,199,724 B2 * 4/2007 Danvir et al. ..... 340/691.1

OTHER PUBLICATIONS

National Fire Protection Association, "Life Safety Code. NFPA 101-2000" National Fire Protection Association, Jun. 2000.

* cited by examiner

*Primary Examiner*—Daryl C. Pope
(74) *Attorney, Agent, or Firm*—James Richards

(57) ABSTRACT

A system and method for providing emergency egress path indication by providing a path direction indicator that is hidden from view during normal operation and is exposed to view upon activation by an emergency signal. Upon being exposed to view the indicator may be lighted and may provide light to people seeking exit from the building. In one embodiment the indicator may include a laser pointer further indicating the direction of egress. Visible and Braille text may also be included on the face of the indicator. The indicator device may be located near floor level for better visibility in smoke environments. In the non-visible state, the indicator may present a rugged face to withstand accidental kicks and bumps as may be encountered when mounted near the floor. The indicator may be operated repetitively and nondestructively to allow inclusion of the indicator in fire and other emergency drills.

17 Claims, 6 Drawing Sheets

MULTI-FUNCTION EGRESS PATH DEVICE

REFERENCES

This application claims the benefit of prior provisional application 60/614,434 filed Sep. 30, 2004 by Kontovich, which is incorporated herein by reference in its entirety.

FIELD OF THE INVENTION

The present invention pertains to the field of safety and emergency equipment and methods, more particularly to egress path indication devices and methods.

BACKGROUND

In an emergency, rapid and orderly evacuation of a building is essential for saving lives and minimizing damage by allowing firefighters full access without having to assist in evacuation or save trapped people who could not find their way out. Evacuation of a building is typically accomplished with reference to a predetermined evacuation plan. Maps are often provided showing the evacuation routes. Drills are often performed to inform occupants of the safety plan and work out any problems that arise. Essential to many plans is a system of lighted EXIT signs and other egress direction indicators. Many Fire Marshals and building codes require such a system.

Fire drills are not always effective in training the necessary occupants as many businesses for example are frequented by customers who are not likely to be present during a fire drill and who would often object to being bothered by a fire drill at a location they infrequently attend.

Exit signs are typically placed near the ceiling, above doorways, where the sign can be seen at a distance and will not be subject to damage from typical traffic, which may include karts, cleaning machinery, and people carrying objects that may bump the walls, potentially damaging fragile transparent plastic or glass lighted signage. In a fire, however, the ceiling may become obscured by smoke Thus, there is a need for an emergency egress device that is operable in a heavy smoke environment, provides intuitive and immediately understandable indication of best egress direction, is rugged enough to withstand normal traffic, and can be nondestructively deployed for fire and safety drills when desired.

BRIEF SUMMARY OF THE INVENTION

Briefly, the present invention is a system and method for providing emergency egress path indication by providing a path direction indicator that is hidden from view during normal operation and is exposed to view upon activation by an emergency signal. Upon being exposed to view the indicator may be lighted and may provide light to people seeking exit from the building. In one embodiment the indicator may include a laser pointer further indicating the direction of egress. Visible and Braille text may also be included on the face of the indicator. The indicator device may be located near floor level for better visibility in smoke environments. In the non-visible state, the indicator may present a rugged face to withstand accidental kicks and bumps as may be encountered when mounted near the floor. The indicator may be operated repetitively and nondestructively to allow inclusion of the indicator in fire and other emergency drills.

These and further benefits and features of the present invention will now be described in detail with reference to exemplary embodiments in accordance with the invention.

BRIEF DESCRIPTION OF THE DRAWINGS

The invention will now be described with reference to the following drawings. In the drawings, like numbers represent identical or similar components. The first digits of a reference number identify the drawing number wherein the reference first appears. In these drawings, when flow lines or wires cross perpendicular to one another, there is no implied connection when a wire or signal line ends touching another line, there is an implied connection. In the drawings.

DETAILED DESCRIPTION OF THE INVENTION

Figure 1:
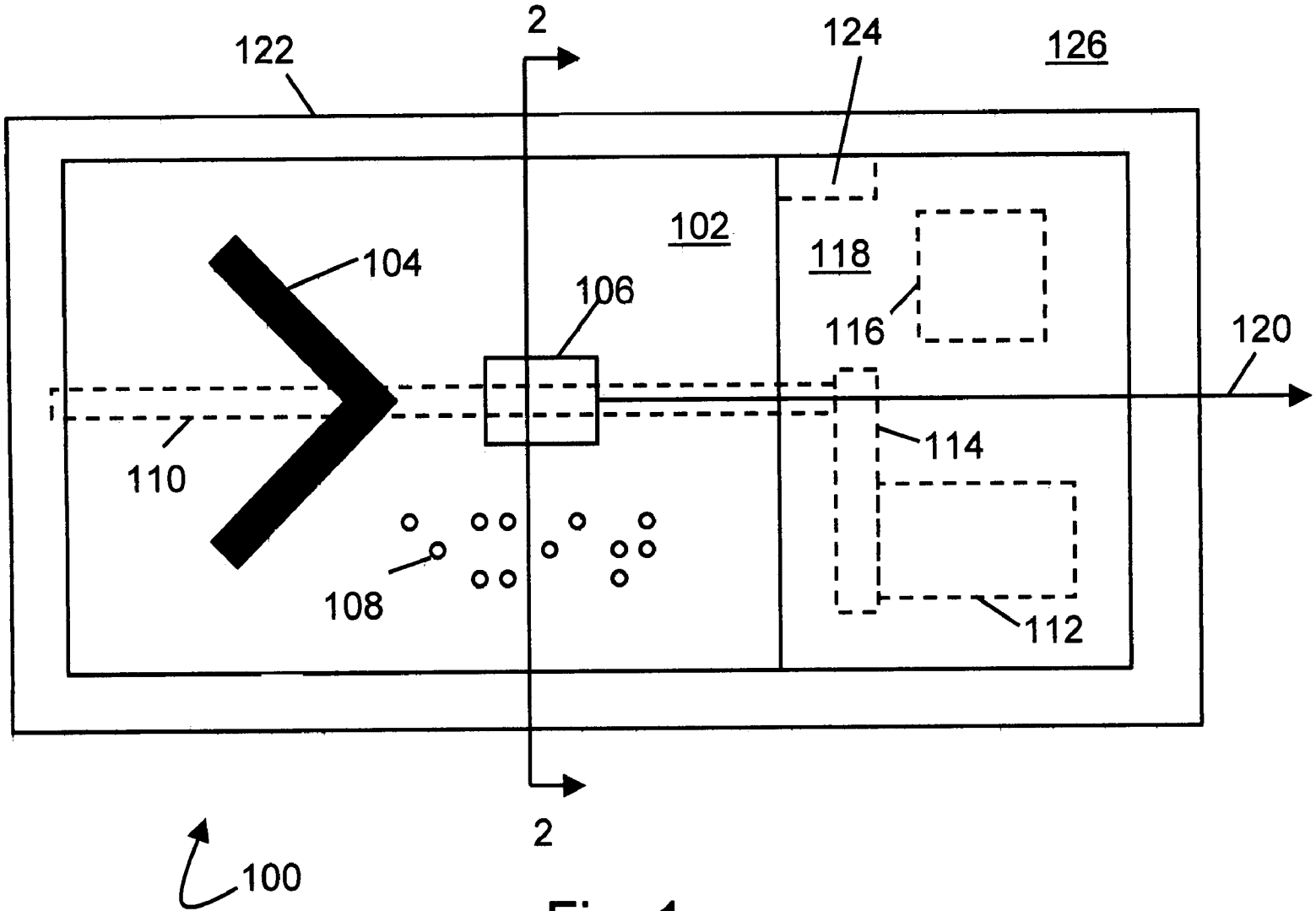
FIG. 1 is a front view of one embodiment of the present invention utilizing a motor to rotate the display into view.

The present invention is a system and method for displaying egress direction information during an emergency. In accordance with the present invention, an egress information display device is installed preferentially near the floor of a room or hallway. The egress information device provides two display configurations. In a first configuration, the safe mode, the device hides the egress display signage and pointing devices and allows a pleasing architectural appearance. In a second configuration, the emergency configuration, the device displays the egress direction information. The second configuration may be entered upon receipt of an emergency signal as provided by, for example, a fire alarm system.

Being located near the floor is especially advantageous in a fire emergency because the smoke usually fills the room initially and most densely near the ceiling, potentially obscuring typical EXIT signs installed above the door. Egress signs located near the floor avoid the smoke and are easily seen by people who have dropped to the floor to avoid the smoke and make their way to the exit.

Being located near the floor however places new demands on egress signage. The egress sign must be more rugged to withstand the abuse of traffic including carts, cleaning machines, and people carrying objects that may bump against the wall. The present invention handles these issues by providing a mode of display such that the display is protected from harm by being rotated out of sight and/or covered by a protective covering. Upon being activated by an emergency signal, the display is brought into view where it is clearly visible providing clear egress direction information.

As a further advantage, the safe mode may be made architecturally pleasing. The device may present a polished stainless steel face or may be covered or painted to match the surrounding wall. The detail of the emergency display need not clutter the room or hallway in the absence of an emergency.

The device may be utilized as part of a fire drill or emergency exercise to familiarize participants with the features and information provided. The device may then be placed back in safe mode, ready when needed for a real emergency. Use of the device in a fire drill verifies proper connection to the emergency signaling system and proper operation of each device in addition to training participants. In addition to fire drills, periodic testing of the device may be included along with routine testing of the building safety equipment.

The device may include multiple features to aid in the determination of egress direction. First, the device may include an arrow pointer or chevron character indicating the direction of the exit. The device may also include a laser pointer directed to the exit. The laser penetrates smoke effectively, providing guidance when outside of the range of the visibility of the sign. In addition, the device may include Braille information for the blind and may include audio information to assist in the exit. Audio information may include a beep, or series of beeps to help locate the device, or may include recorded voice commands, or may include live audio, one or two way.

Further details and understanding of the invention will now be provided with reference to the drawings.

FIG. 1 is a front view of one embodiment of the present invention utilizing a motor to rotate the display into view. Referring to FIG. 1, the egress direction display 100 comprises a faceplate 102 mounted on a shaft 110. A lighted directional character 104 in the form of a chevron character 104 comprising an array of LED lights is mounted on the faceplate 102. A laser pointer 106 may also be mounted on the faceplate 102. The chevron 104 and the laser pointer 106 may be directed in the direction of the desired exit. Also shown is a Braille message 108 indicating the exit. The embodiment shown in FIG. 1 includes multiple features (the chevron 104, laser 106, and Braille 108), however, one or more may be provided in a given instance. The directional character 104 may be a chevron as shown or an arrow or other indication as required by codes or generally understood as indicating direction. Light Emitting Diodes (LED's) are desirable for brightness, long life, reliability and efficiency; however, other light sources may be used, such as a back lighted sign. Red or green LED's are preferred, but any color may be used. In one embodiment, the LED light provides sufficient light to aid an occupant to see the path to the exit. Alternatively, supplemental lights may be provided.

In an alternate embodiment, the device may be an EXIT sign and may indicate "EXIT" instead of the chevron indicating direction. The device may be placed by an exit near the floor to supplement an always visible exit sign above the door.

The laser pointer 106 may be any color, but the color is preferably selected for smoke penetration and visibility.

The faceplate 102 is mounted on a shaft 110, which is rotated by a motor 112 through a drive mechanism 114. The motor 112 rotates the faceplate 180 degrees to expose either the egress display (emergency mode) or a blank side (safe mode) opposite the egress display. The faceplate may further be secured in position by rotating against mechanical stops and/or by using a solenoid actuated release 124.

A control compartment 118 within the overall housing houses a controller 116 and the motor 114. If desired, an audio device may also be included. The audio device may be housed in the control compartment 118 or mounted on the faceplate 102.

A flange 122 is provided for mounting the device 100 recessed in a wall 126. The device 100 may alternatively be surface mounted on the wall 126.

In one embodiment, the faceplate may be 4¾×4½ inches (12.1×11.4 cm). The control compartment may be 3¾ Wide× 4½ High×3 in. Deep (9.5×11.4×7.6 cm). The device may have a ½ inch (1.27 cm) flange for mounting. Thus, the overall dimensions including the flange may be 10½ in wide× 5½ in high×3 in deep (26.7×14 ×7.6 cm). The dimensions are exemplary only and may be varied to produce a larger or smaller display or to accommodate different controller mechanisms or a different set of features.

The device 100 may be made wet location safe by sealing the controller compartment and electronics from water entry and by double insulating power source and interface circuits. Wet location safety is very desirable because the device may be called to operate concurrently with building fire sprinkler systems and should continue to operate properly and not pose a shock hazard.

Figure 2:
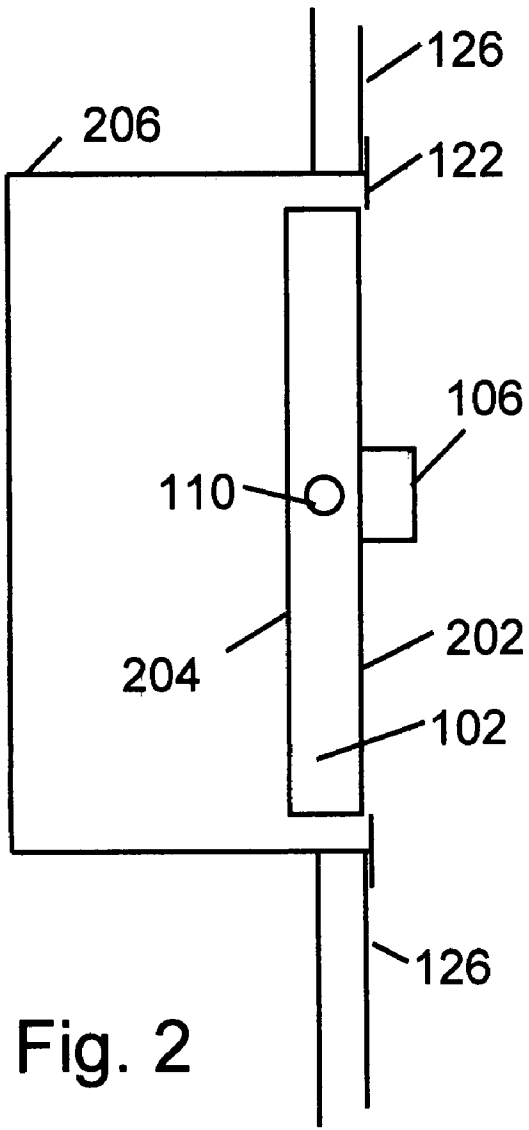
FIG. 2 is a crops section view through the device of FIG. 1.

FIG. 2 is a cross section view through the device of FIG. 1. FIG. 1 and FIG. 2 represent the device in the emergency mode, with the display exposed to view. Referring to FIG. 2, the device housing 206 is recessed into the wall 126 and mounted to the wall 126 using the flange 122 provided. Other mounting methods may be used as are commonly used with electrical equipment. The device 100 may also be surface mounted to the wall 26 (not shown) by attaching the back of the housing 206 to the wall.

The display plate 102 (also called faceplate 102) is shown in emergency display mode, with the display face 202 outward and the blank face 204 (also called plain face 204) inward. The laser 106 is mounted to the display plate 102. The rotational shaft 110 is shown through the center of the plate 102. The rotational shaft 110 may be placed on a vertical axis (not shown) or horizontal axis (as shown). When the shaft is placed in the center of the vertical dimension of the plate 102, the plate 102 rotates "in place", i.e. the blank face 204 and display face 202 swap places when the plate 102 is rotated.

Figure 3:
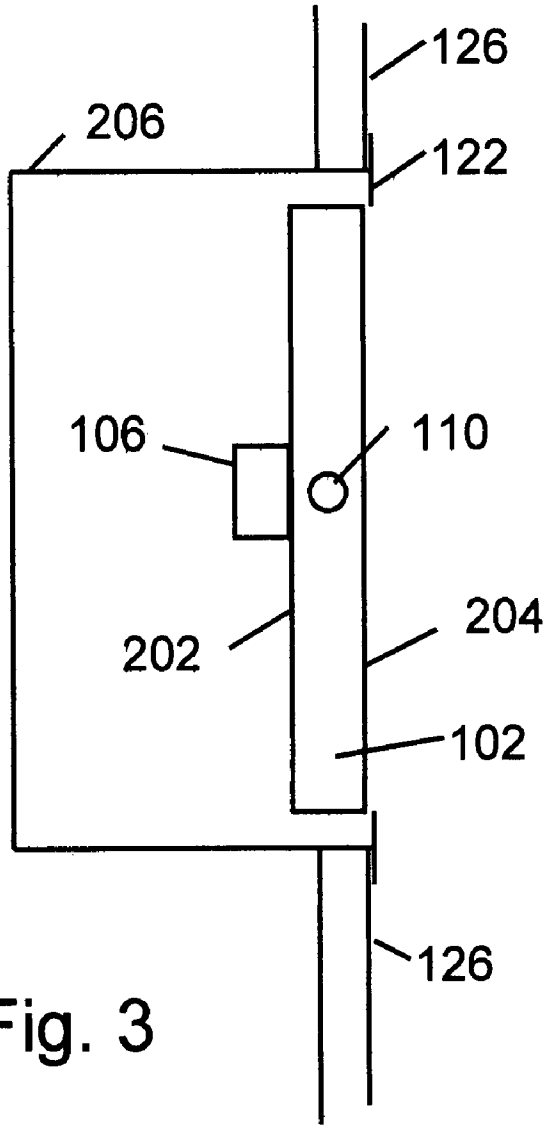
FIG. 3 illustrates the device of FIG. 2 rotated to the safe mode position.

FIG. 3 illustrates the device of FIG. 2 rotated to the safe mode position. Referring to FIG. 3, note that the display face 202 and blank face 204 have swapped position with respect to FIG. 2. The laser 106 is inside and protected from damage and so is the LED chevron display (not shown). The blank face 204 may be made of rugged stainless steel or other material. The blank face 204 may be painted or wall papered or covered with a wide range of architectural coverings as desired for pleasing appearance. Rotational stops and latches 124 may be provided to stabilize the plate 102 in the safe mode. Solenoids may be used to unlatch the latches to allow rotation.

The rotational axis of the shaft 110 is shown in the center of the vertical dimension of the plate, however the axis may be placed at other locations. Placing the axis off center potentially allows shallower depth in the housing and typically requires a portion of the plate to swing outside the housing. One example of an alternate axis is shown in FIG. 4.

Figure 4:
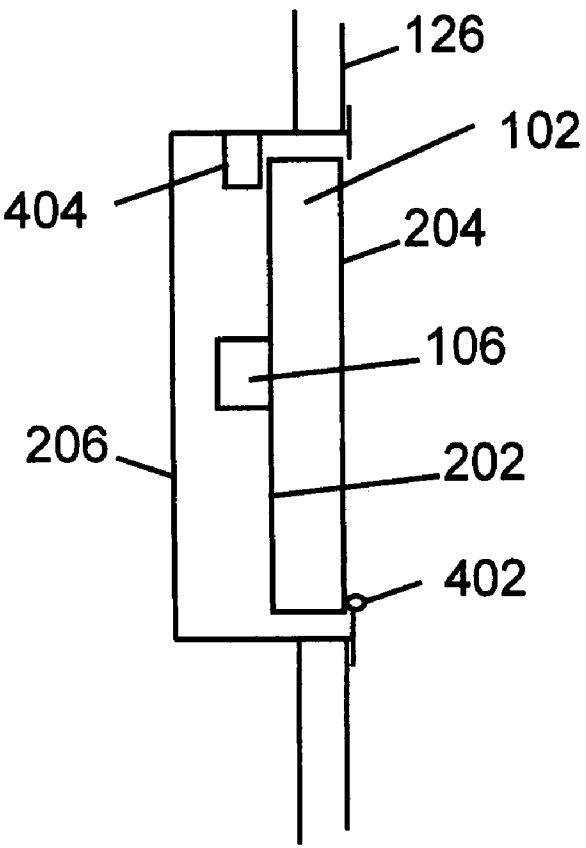
FIG. 4 illustrates an alternate embodiment with the rotational axis near the end of the plate.

FIG. 4 illustrates an alternate embodiment with the rotational axis near the end of the plate. The device of FIG. 4 also uses an alternate actuator mechanism comprising a spring loaded hinge 402 and a solenoid operated latch 404. FIG. 4 shows the device in the safe mode. Referring to FIG. 4, the plate 102 is mounted by a hinge 402 at the bottom. The hinge 402 includes a spring configured to rotate the plate 102 clockwise as shown in the view, swinging below and outside of the housing 206. The plate 102 is held closed in safe mode by a solenoid operated latch 404. When the solenoid is operated, the latch 404 releases the plate 102 and the spring (aided by gravity) rotates the plate 102 down to expose the display side 202 to view. The display configuration is shown in FIG. 5.

Figure 5:
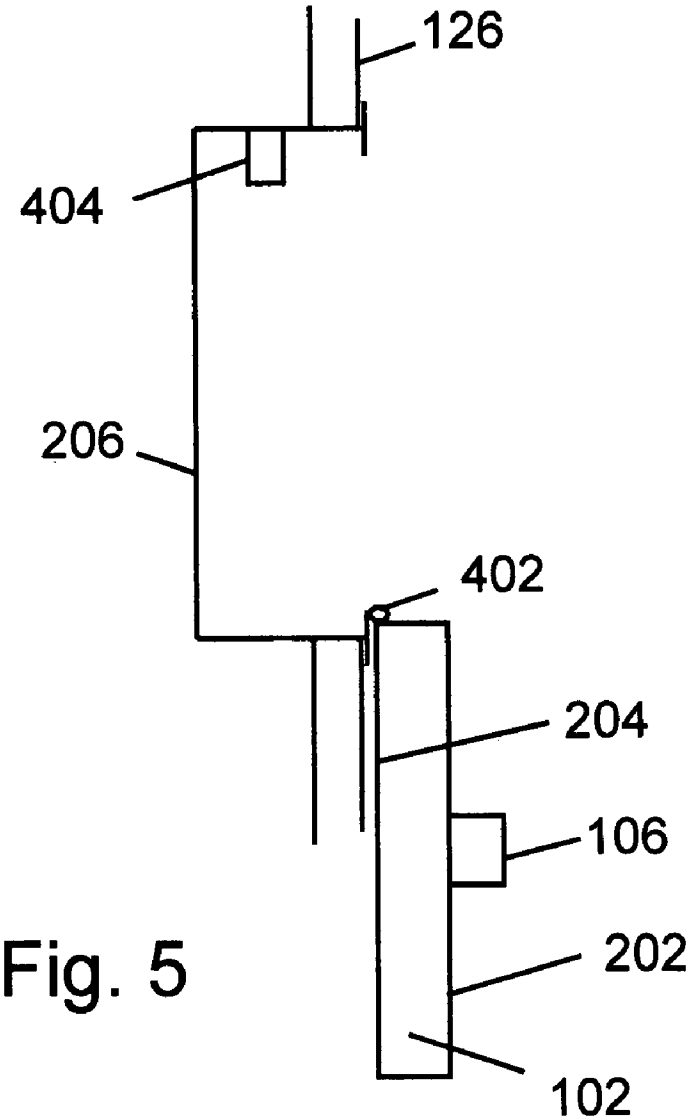
FIG. 5 illustrates the display configuration of the device of FIG. 4.

FIG. 5 illustrates the display configuration of the device of FIG. 4. Referring to FIG. 5, the plate 102 is rotated to expose the display side 202 to view. The laser 106 is shown outside the housing 206 with the beam directed parallel to the wall 126.

Note that the embodiment of FIGS. 4 and 5 has been discussed as though the plate 102 swings down, however the device may be oriented to swing the plate horizontally or up, vertically, as desired.

Figure 6:
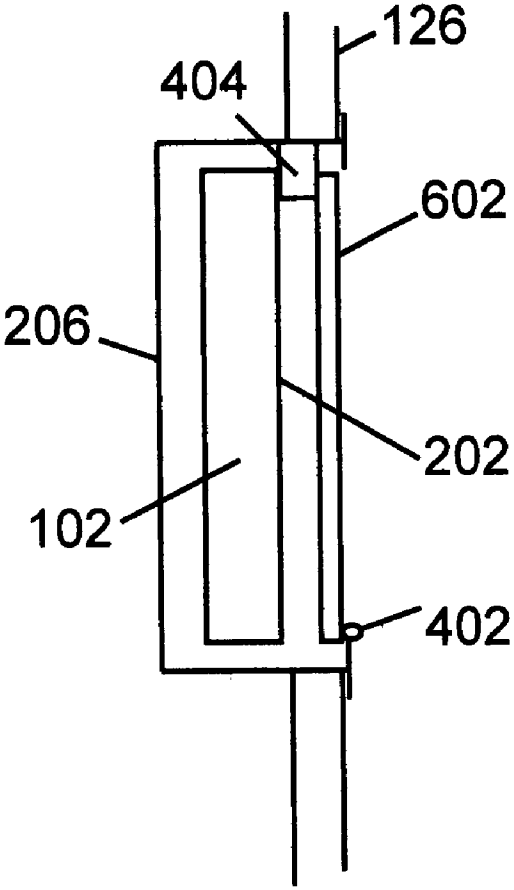
FIG. 6 illustrates an alternate embodiment utilizing a hinged cover.

FIG. 6 illustrates an alternate embodiment utilizing a hinged cover. FIG. 6 shows the device in the safe mode. Referring to FIG. 6, the display is shown without the laser for exemplary purposes. The laser may optionally be provided. In FIG. 6, the display face 202 is internal to the device and is protected by the cover 602. The cover 602 acts as the blank face 204 of the device and may be ruggedized or covered with architectural coverings as described above for the blank face 204. The cover 602 is mounted with a spring loaded hinge 402 and is released by a solenoid operated latch 404 as has been described above.

Figure 7:
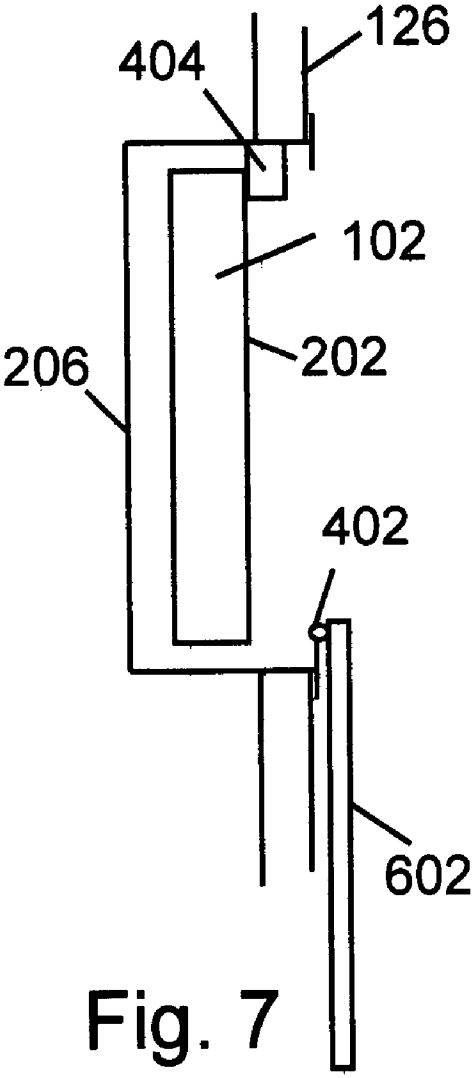
FIG. 7 shows the device of FIG. 6 in the emergency mode.

FIG. 7 shows the device of FIG. 6 in the emergency mode. Note that the display face 202 is recessed in FIG. 7. A slight recess may be acceptable when the chevron is the primary display feature provided. When the laser 106 is provided, it may, in some cases, be necessary to direct the laser beam 120 parallel or nearly parallel to the wall 126, requiring the laser 106 to protrude external to the housing 206.

To accommodate this requirement, the plate 102 including the laser 106 or the laser 106 alone may be mounted on a movable mount 802 (see FIG. 8), either motorized or spring driven to move the laser 106 outside the housing 206 for full exposure, allowing operation of the beam 120 parallel to the wall 126.

Figure 8:
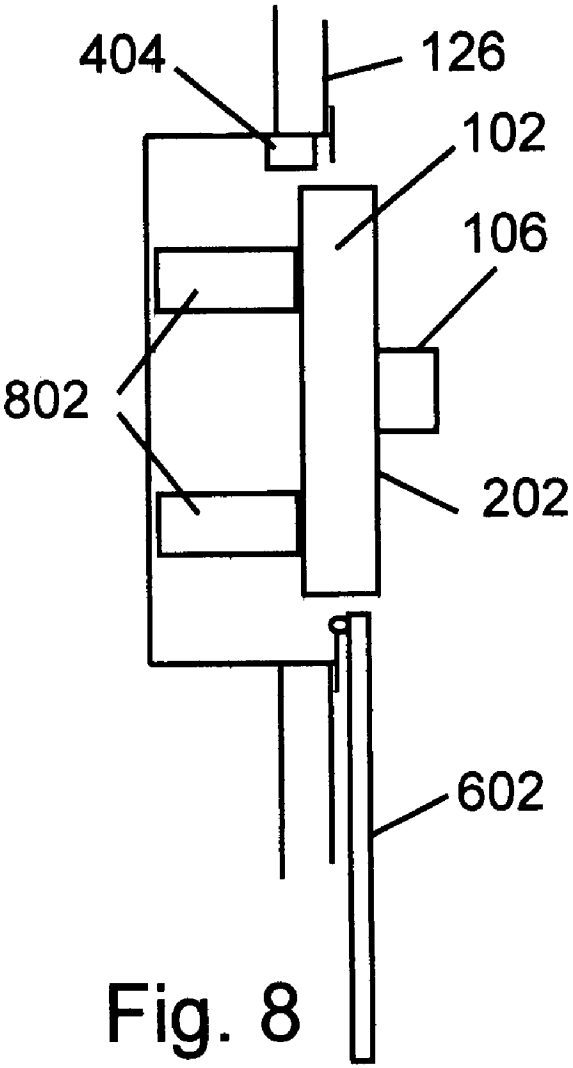
FIG. 8 illustrates a movable mount embodiment allowing the laser to protrude beyond the housing.

FIG. 8 illustrates a movable mount embodiment allowing the laser 106 to protrude beyond the housing 206. Referring to FIG. 8, the plate 102 is mounted on a movable mount 802. The movable mount 802 may be a motor driven mount or may be a spring loaded mount, i.e a coil spring or leaf spring or other spring shape that allows the plate 102 including the laser 106 to exit or partially exit the housing 206 for greater external view exposure. In an alternate embodiment (not shown), the plate 102 is fixed and the laser 106 is mounted on the movable mount.

In an alternative embodiment, the cover 602 may slide to expose the display 202, or the display 202 may slide from under the cover 602.

Figure 9:
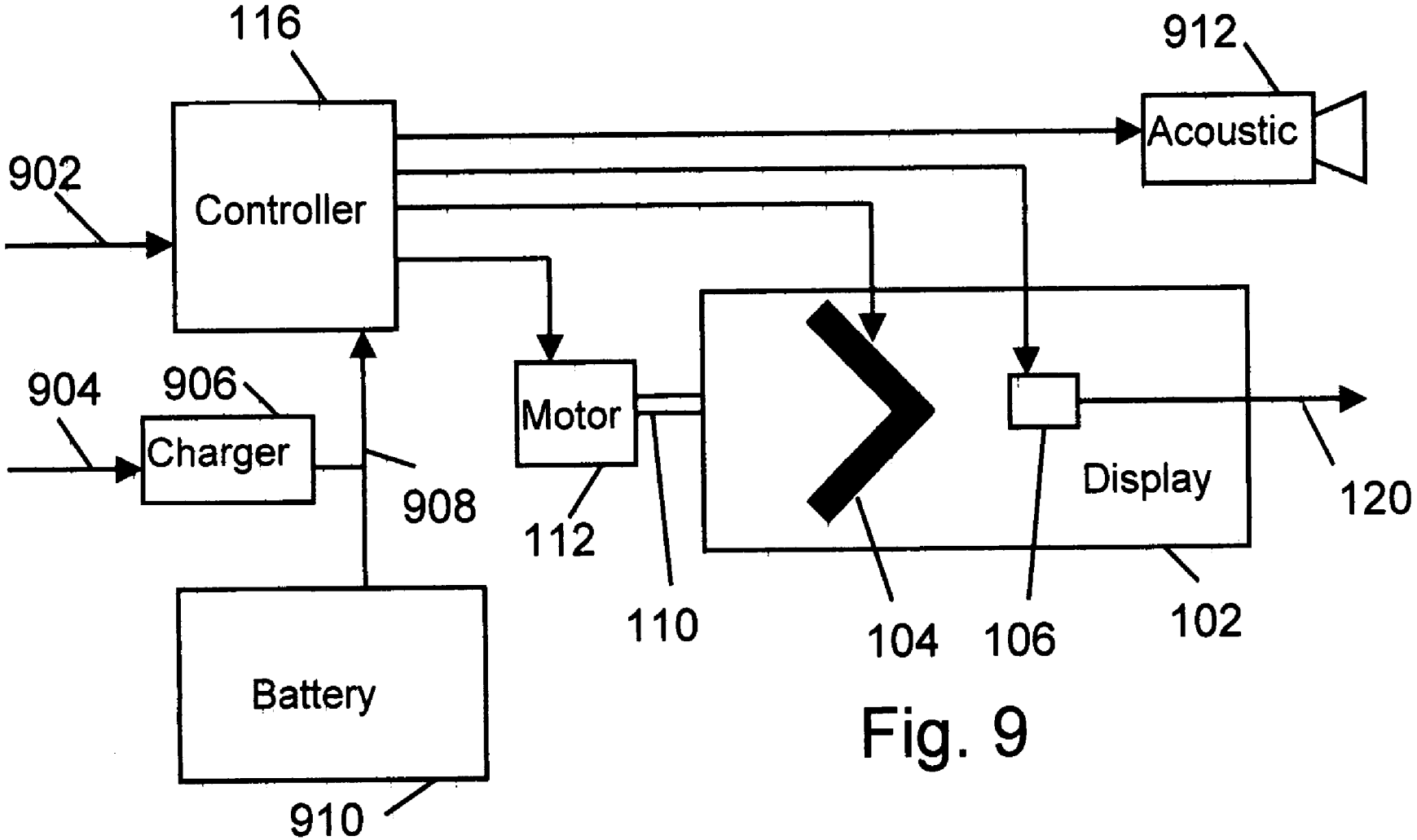
FIG. 9 is a functional block diagram showing the operation of the device.

FIG. 9 is a functional block diagram showing the operation of the device. Referring to FIG. 9, operation of the device is controlled by a control unit 116. Power is supplied by a battery 910 that is kept charged by a battery charger 906 supplied from mains power 904. The battery 910 allows operation in the case of loss of mains power 904, which would likely be switched off soon after discovering an emergency condition. The controller 116 receives an emergency signal 902, potentially from a fire alarm system or other emergency system. Upon receiving the emergency signal 902, the controller 116 operates the actuator 112 which changes the mechanical configuration from safe mode to emergency mode. The controller 116 may also activate the lighted chevron display 104, laser 106, and acoustical signal 912. The chevron 104 or laser 106 or both may flash or may be steady. The acoustic system may be responsive to external audio (not shown) as required for a particular application.

Figure 10:
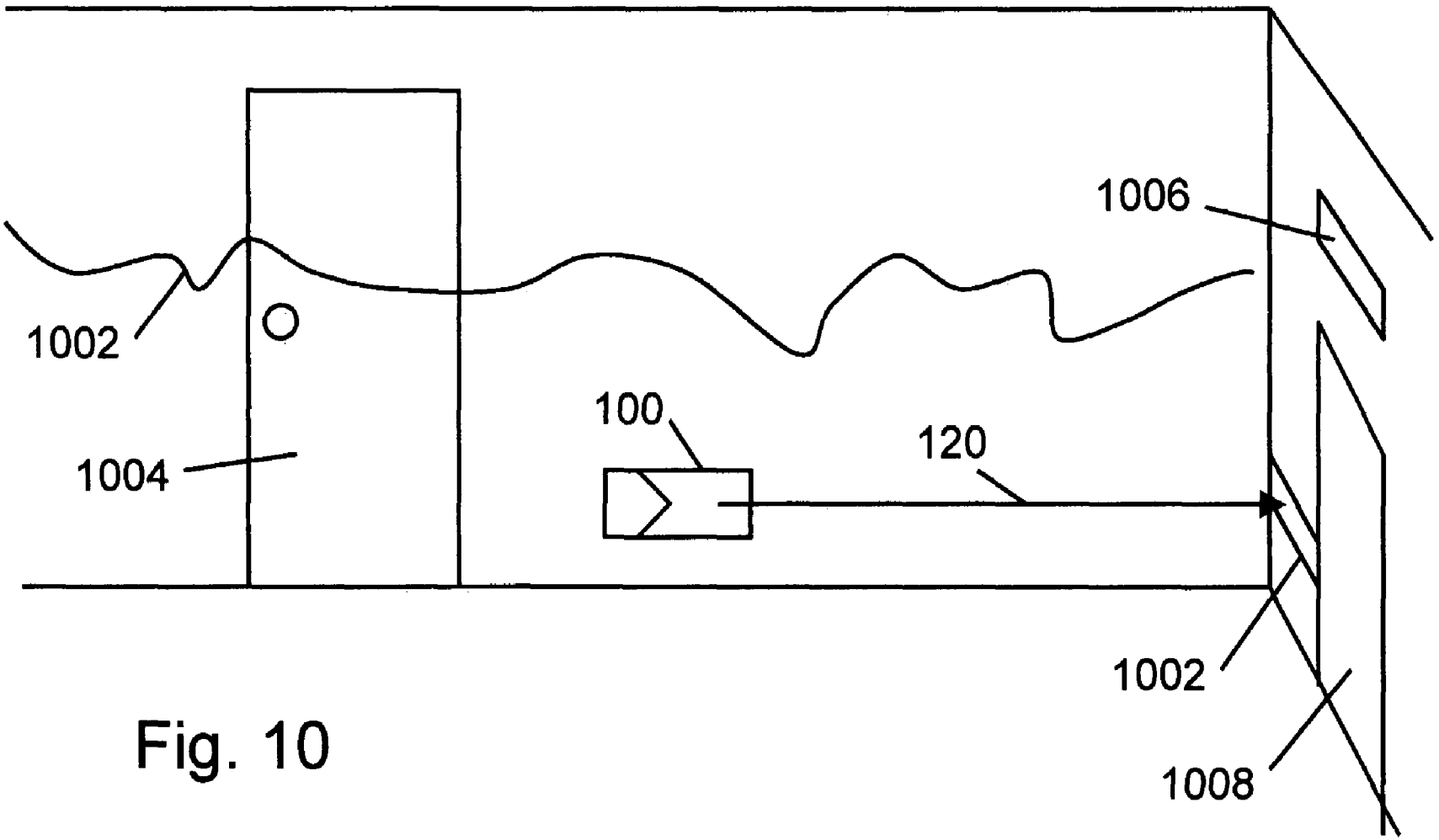
FIG. 10 illustrates a typical application environment.

FIG. 10 illustrates a typical application environment. FIG. 10 may represent a hallway in a hotel, for example. Referring to FIG. 10, an egress direction information device 100 is installed in the wall near the floor. Smoke 1002 has obscured the upper portion, obscuring the exit sign 1006 above the exit door 1008. An auxiliary exit sign 1002 is provided near the floor beside the exit door 1008. The auxiliary exit sign 1002 utilizes the safe mode and emergency mode configurations of the present invention as are utilized by the egress direction device 100.

Upon receiving an emergency signal from a triggered fire alarm, the egress direction indicator 100 would deploy to emergency mode to display the egress direction information. An occupant exiting a hotel room door 1004 would drop to the floor and observe the egress direction device 100 to ascertain the direction of the nearest exit 1008. After proceeding in the direction of the exit 1008, the egress direction sign 100 may be lost in smoke (low level smoke may be thinner, but may still be present at lower levels). The laser beam 120 may be used as a guide until the auxiliary EXIT sign 1002 or 1008 comes into view. The occupant may then assess the exit door 1008 and carefully open, if not hot, and hopefully, proceed to safety.

CONCLUSION

Thus, the present invention provides for an emergency egress device that is operable in a heavy smoke environment, provides intuitive and immediately understandable indication of best egress direction, is rugged enough to withstand normal traffic, and can be nondestructively deployed for fire and safety drills when desired.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An apparatus for indicating egress direction in an emergency comprising:

a face plate having a plain face and an indication face, said plain face for presenting a pleasing architectural appearance, said indication face for presenting egress direction indication;

an actuator, said actuator coupled to said face plate, said actuator moving said face plate from a first position to a second position in response to an emergency signal, said first position exposing said plain face and hiding said indication face; said second position exposing said indication face.

2. The apparatus of claim 1, wherein the actuator comprises a motor.

3. The apparatus of claim 1, wherein the direction indicator is a back lighted sign.

4. The apparatus of claim 1, wherein the direction indicator comprises an array of LED's.

5. The apparatus of claim 1, wherein the direction indicator includes a chevron shape character.

6. The apparatus of claim 1, further including a laser mounted on said indication face for indicating egress direction.

7. The apparatus of claim 1, further including an acoustic signal for indicating egress direction.

8. The apparatus of claim 7, wherein the acoustic signal comprises a beep.

9. The actuator of claim 7, wherein the acoustic signal comprises a voice message.

10. The apparatus of claim 1, wherein the actuator rotates said face plate from said first position to said second position.

11. The apparatus of claim 1, further including a cover over said face plate, wherein said actuator moves said cover to expose said face plate to view.

12. The apparatus of claim 11, wherein said cover is rotateably mounted and said actuator rotates said cover to expose said face plate to view.

13. The apparatus of claim 11, wherein said cover is slideably mounted and said actuator slides said cover to expose said face plate to view.

14. An apparatus for indicating egress direction in an emergency comprising:

a face plate having an egress direction indication;

a cover for presenting a pleasing architectural appearance;

an actuator, said actuator coupled to said cover, said actuator moving said cover from a first position to a second position in response to an emergency signal, said first position hiding said face plate; said second position exposing said face plate to view.

15. The apparatus of claim 14, wherein said cover is rotateably mounted and said actuator rotates said cover to expose said face plate to view.

16. The apparatus of claim 14, wherein said cover is slideably mounted and said actuator slides said cover to expose said face plate to view.

17. The apparatus of claim 14, further including a movable mount coupled to said direction indication, wherein said direction indication is moved to better expose the direction indication to view in response to said emergency signal.

* * * * *